United States Patent [19]

Zagustin et al.

[11] Patent Number: 4,753,261

[45] Date of Patent: Jun. 28, 1988

[54] CORE-ANNULAR FLOW PROCESS

[75] Inventors: Konstantin Zagustin; Emilio Guevara; Gustavo Nunez, all of Caracas, Venezuela

[73] Assignee: Intevep, S.A., Caracas, Venezuela

[21] Appl. No.: 116,527

[22] Filed: Nov. 2, 1987

[51] Int. Cl.[4] ..... F17D 1/16

[52] U.S. Cl. ..... 137/13; 137/268

[58] Field of Search ..... 137/13, 1, 268

[56] References Cited

U.S. PATENT DOCUMENTS

| | | | |
|---|---|---|---|
| 3,225,787 | 12/1965 | Fogarty | 137/1 X |
| 3,502,103 | 3/1970 | Verschuur | 137/13 X |
| 3,826,279 | 3/1974 | Verschuur | 137/13 X |
| 3,892,252 | 7/1975 | Poettmann | 137/13 |

*Primary Examiner*—Alan Cohan

*Attorney, Agent, or Firm*—Bachman & LaPointe

[57] ABSTRACT

A process for transporting viscous oil in a pipeline is described which comprises placing a spherical sealed pig within the pipeline at a desired position; filling a fraction of the pipeline upstream of the pig with a low viscosity fluid such as water; and initiating core flow of a viscous oil such as a heavy or extra heavy crude oil after the first fraction has been filled. The process permits the core-flowed viscous oil to be transported in the same pipeline with a non-core-flowed fluid. To do this, a second pig is placed in the pipeline intermediate the core-flowed viscous oil and the non-core-flowed fluid and a second fraction of the pipeline intermediate the second pig and the core-flowed viscous oil batch is filled with a low viscosity fluid such as water.

10 Claims, 2 Drawing Sheets

CORE-ANNULAR FLOW PROCESS

BACKGROUND OF THE INVENTION

The present invention relates to the field of transporting viscous fluids such as extra heavy crude oils, bitumen or tar sands which hereinafter will be referred to as viscous oils.

Friction losses are often encountered during the pumping of viscous fluids through a pipeline. These losses are due to the shear stresses between the pipe wall and the fluid being transported. When these friction losses are great, significant pressure drops occur along the pipeline. In extreme situations, the viscous fluid being transported can stick to the pipe walls, particularly at sites which are sharp changes in the flow direction.

A known procedure for reducing friction losses within the pipeline is the introduction of a less viscous immiscible fluid such as water into the flow to act as a lubricating layer for absorbing the shear stress existing between the walls of the pipe and the fluid. This procedure is known as core flow because of the formation of a stable core of the more viscous fluid, i.e. the viscous oil, and a surrounding, generally annular, layer of less viscous fluid. U.S. Pat. Nos. 2,821,205 to Chilton et al. and 3,977,469 to Broussard et al. illustrate the use of core flow during the pipeline transmission of oil.

Normally, core flow is established by injecting the less viscous fluid around the more viscous fluid being pumped in the pipeline. U.S. Pat. Nos. 3,502,103 and 3,826,279, both to Verschuur, and 3,886,972 to Scott et al. illustrate some of the devices used to create core flow within a pipeline. An alternative approach for establishing core flow is illustrated in U.S. Pat. No. 4,047,539 to Kruka wherein the core flow is created by subjecting a water-in-oil emulsion to a high shear rate.

Although fresh water is the most common fluid used as the less viscous component of the core flow, other fluids or a combination of water with additives have been used. U.S. Pat. No. 3,892,252 to Poettman illustrates a method for increasing the flow capacity of a pipeline used to transport fluids by introducing a micellar system into the fluid flow using a hollow pig. The micellar system comprises a surfactant, water and a hydrocarbon. The hollow pig exudes the micellar system onto the walls of the pipe as it is carried downstream by the transport fluid.

U.S.S.R. Pat. No. 485,277 to Avdshiev illustrates a core flow method which uses a lower viscosity fluid formed by an emulsion of a light fraction of hydrocarbon in water. U.S.S.R. Pat. No. 767,451 to Budina et al. illustrates a core flow method wherein the lower viscosity fluid is a solution of water and synthetic tensoactive agents.

While extensive experimental and analytical studies have been carried out to demonstrate that core-annular flow is a feasible method for the transport of heavy and extra-heavy crude oils and bitumen at ambient temperatures, little, if any, attention has been given to the manner in which this flow pattern is to be established in a commercial pipeline. The effectiveness of the commercial use of core flow is related to its adaptability to existing pipeline systems. It is then clear that core-flowing viscous oils involves not only basic technical questions but also operational methodologies aimed at increasing the flexibility of the method. In particular, pipeliners should be able to utilize core-flow in existing pipelines which, in turn, implies that its use involves the sharing of the pipeline with other types of fluids that are not core-flowed. This latter requirement places a severe constraint to the use of core-flow, since the standard method for establishing it requires a multi-step process consisting of the following. First, the entire pipeline is emptied. Second, it is filled with water. Finally, the water is displaced by the viscous oil which as it moves through the line forms the core-flow pattern.

Accordingly, it is an object of the present invention to provide a new process for establishing core-flow in commercial pipeline systems.

It is a further object of the present invention to provide a process as above which does not require the pipeline to be emptied.

It is yet a further object of the present invention to provide a process as above which allows the batching of core-flow transported viscous oil with other fluids.

These and other objects and advantages will become more apparent from the following description and drawings in which like reference numerals depict like elements.

SUMMARY OF THE INVENTION

The foregoing objects and advantages are achieved by a process for transporting viscous oil in a pipeline which comprises: placing a first sealed pig, preferably spherical in configuration, within the pipeline at a desired position; filling a first fraction of the pipeline preferably greater than about 100 pipe diameters in length with a low viscosity fluid such as water; and initiating core flow of a first viscous oil such as a heavy or extra-heavy crude oil after the first fraction has been filled. The core flow initiating step preferably comprises injecting the viscous oil into a central portion of the pipeline and simultaneously forming an annular layer of the low viscosity fluid about the viscous oil.

The process of the present invention permits the core-flowed viscous oil to be transported along with at least one other non-core-flowed fluid such as a light crude oil. To do this, a second pig such as a squeegee pig is placed in the pipeline intermediate the core-flowed oil and the non-core-flowed fluid. To prevent contamination of the core-flowed oil by the non-core-flowed fluid, a second fraction of the pipeline about 100 pipe diameters in length intermediate the second pig and the core-flowed oil is filled with a low viscosity fluid such a water.

DETAILED DESCRIPTION

As previously discussed, the process of the present invention provides a remedy to certain limitations of other core-flow processes. For example, there is no need to empty the entire pipeline using the process of the present invention. There is also no need with the process of the present invention to fill the pipeline with water prior to the establishment of the core-flow.

Figure 1:
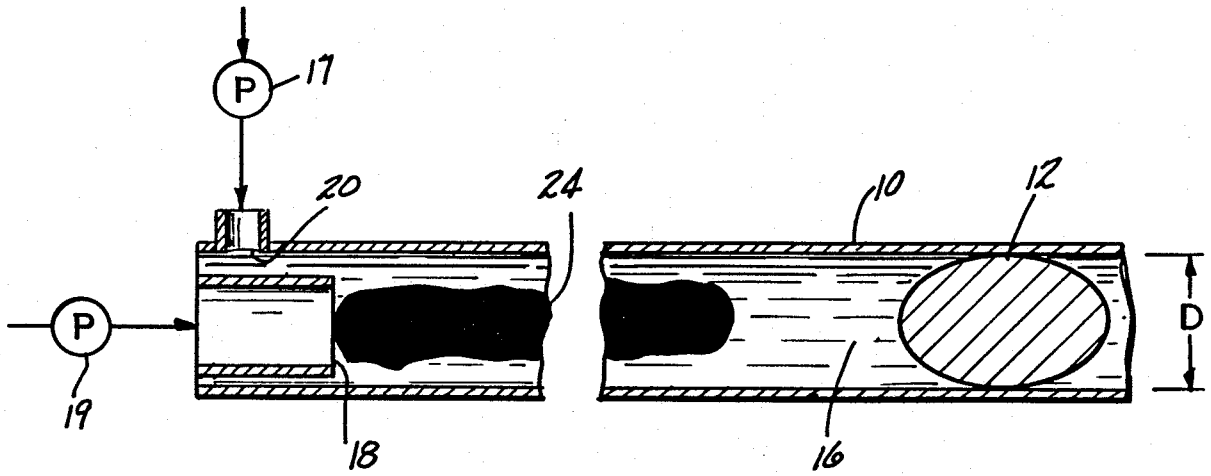
FIG. 1 is a cross sectional view of a portion of a pipeline in which core flow has been established in accordance with the process of the present invention.
Figure 2:
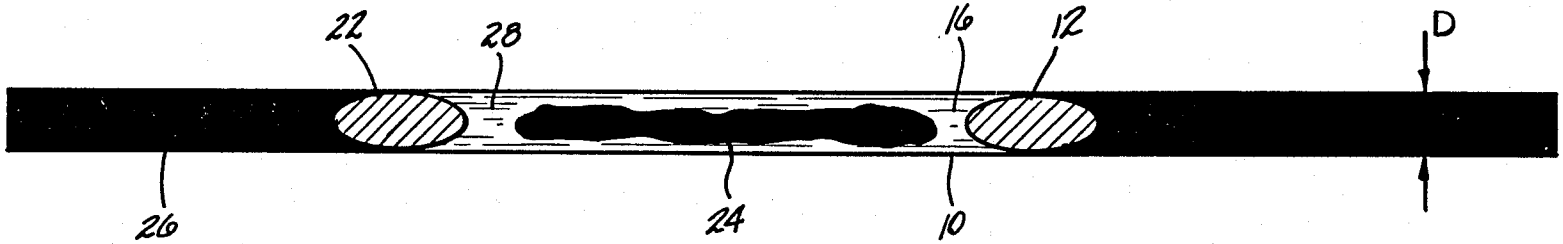
FIG. 2 is a cross sectional view of a pipeline in which core-flowed viscous oil is transported along with a non-core-flowed fluid in accordance with the process of the present invention.

FIG. 1 illustrates a portion of a pipeline 10 in which core flow of a viscous oil is to be established. As used herein, the phrase "viscous oil" refers to an oil having a density in the range of from about 1.02 to about 0.96 grams per milliliter and a viscosity in the range of from about 3,000 centipoises to about 1,000,000 centipoises. The pipeline 10 may be empty or it may be filled with some other fluid such as water, another low viscosity fluid, a non-core-flowed oil or some other liquid.

To initiate the process of the present invention, a pig 12 such as a substantially spherical sealed pig is placed in the pipeline 10 at a desired location such as a desired core-flow front. The pig is inserted into the pipeline by means of a pig luncher. There is no restriction on the pig material to be used.

Next, a fraction 16 of the pipe upstream of the pig 12 is filled with a low viscosity fluid such as water. Preferably, a length of pipe greater than about 100 pipe diameters D is filled with the low viscosity fluid, to prevent the contact of the viscous oil core with the pig.

After the section 16 of the pipe has been filled with the low viscosity fluid, core-flow of the viscous oil is established. The core flow may be established using any suitable technique known in the art. Preferably, the viscous oil is injected into a central portion of the pipe through any suitable nozzle 18 available in the art by operation of a pump 19. Simultaneously, a low viscosity fluid, preferably water, is injected into the pipe via pump 17 and nozzle 20 at a fraction and a flow rate sufficient to obtain the critical velocity needed to form an annular flow of low viscosity fluid about the core viscous oil flow. A particularly useful water fraction for establishing core flow is in the range of 4% to about 12%, preferably from about 7% to about 12%, ideally at about 8%. Using this technique, as the pig 12 advances through the pipeline, the core-flow is established upstream of it.

If it is desired to batch a non-core-flowed fluid 26 such as light crude oil having a density in the range of 0.82 to about 0.96 grams per milliliter and a viscosity in the range of from 1 centipoise to about 3,000 centipoises, a second pig 22 is placed in the pipeline upstream of the core-flowed oil 24. Since the second pig 22 transfers momentum to the core-flowed oil 24 the identity of the core-flowed oil 24 is better preserved utilizing a squeegee pig.

To further prevent contamination of the core-flowed oil 24 by the non-core-flowed fluid 26, a portion 28 of the pipeline intermediate the core-flowed oil 24 and the pig 22 is filled with a low viscosity fluid such as water. Preferably, the portion 28 has a length substantially equal to about 100 pipe diameters D.

In the batching of core flow, care should be taken to maintain the pipeline system running to avoid damaging overpressures which can occur during start up procedures after a long standstill period.

To demonstrate the advantages of the process of the present invention, the following example was performed.

EXAMPLE I

Three types of viscous oil were pumped in batches through a 50 km, 30 inch horizontal pipeline having a total daily production of 100,00 barrels. The API gravities of the fluids were 8.4, 30.3 and 24.4. Of the three, the heaviest (i.e. that of the 8.4° API) was core-flowed.

Figure 3:
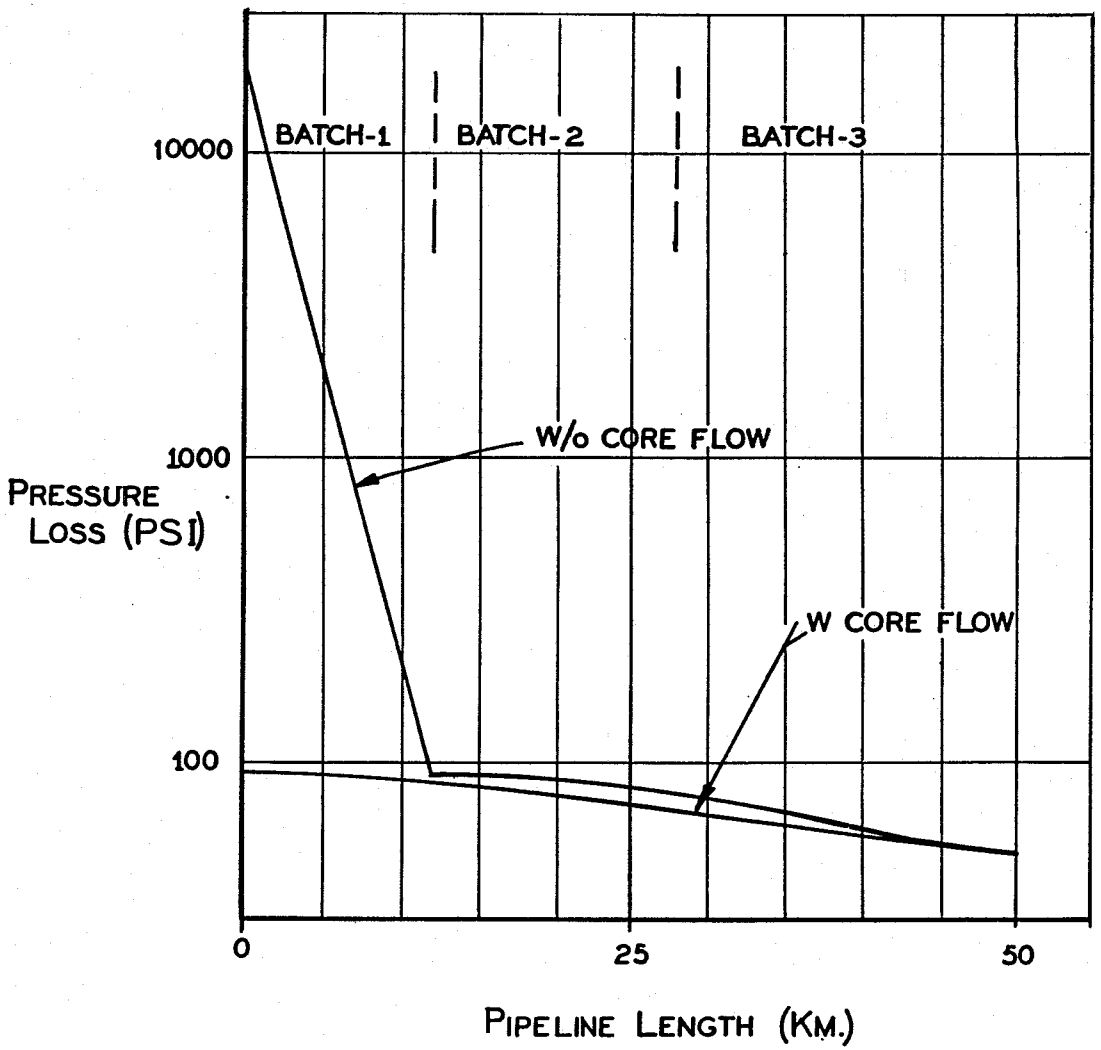
FIG. 3 is a graph illustrating the pressure loss behavior with and without core flow in a batched flow.

FIG. 3 displays two curves, one corresponding to the case in which the 8.4° API batch is core-flowed and one in which this batch is not core-flowed. The length of the batches are 12 km for the 8.4° API oil, 16 km for the batch containing the 30.3° API crude oil, and 22 km for the 24.4° API batch.

As can be seen from FIG. 3, there exists a tremendous difference in pressure drop between the two cases, more than a 100 times. This indicates that batching such a viscous oil without core flow is both undesirable and practically impossible.

EXAMPLE II

With a line (1 Km×8 inch) empty, a first pig was introduced through a pig Launcher Station by injecting water for about seven (7) minutes at a rate of about 1300 gpm. After this period of time, the water injection was interrupted and reinitiated through the injection nozzle at a rate of 24 gpm simultaneously with the injection of very viscous oil at a rate of about 280 gpm. During this operation, the first pig moved a portion of the pipeline length, about 400 m.

The operation was then interrupted and a second pig was introduced through the pig Launcher Station after the water was pumped for about 7 minutes at a rate of 270 gpm.

Once the second pig was introduced, the entire system, i.e., the first pig followed by a batch of a very viscous oil surrounded by a water film and the second pig, was transported through the line by pushing it with water at a rate of 270 gpm. The pressure drop during this operation was 5.8 psi. In comparison, the estimated pressure drop when the very viscous oil is being core flowed without the pig was 2.75 psi.

It is apparent that there has been provided in accordance with this invention, a core-annular flow process which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to encompass all such alternatives, modifications, and variations as fall within the spirit and broad scope of the appended claims.

What is claimed is:

1. A process for transporting viscous oil in a pipeline which comprises:

placing a first sealed pig within said pipeline at a desired position;

filling a first fraction of said pipeline upstream of said pig with a low viscosity fluid; and initiating core flow of a first viscous oil after said first fraction has been filled, wherein the flow of low viscosity fluid in said pipeline and said core flow cause said pig to advance along said pipeline.

2. A process as in claim 1 wherein said filling step comprises filling a length of said pipeline greater than about 100 pipe diameters with water.

3. A process as in claim 2 wherein said core flow initiating step comprises injecting said first viscous oil into a central portion of said pipeline and simultaneously forming an annular layer of said water about said viscous oil.

4. A process as in claim 3 wherein said viscous oil injecting step comprises injecting oil having a density in the range of from about 1.02 to about 0.96 grams per milliliter and a viscosity in the range of from about 3,000 centipoises to about 1,000,000 centipoises.

5. A process as in claim 1 wherein said placing step comprises placing a substantially spherical pig into said pipeline.

6. A process as in claim 1 further comprising simultaneously transporting one other non-core flowed fluid within said pipeline.

7. A process as in claim 6 further comprising:

placing a second pig intermediate said core flowed oil and said non-core flowed fluid.

8. A process as in claim 7 further comprising:

filling a second fraction of said pipeline intermediate said second pig and said core flowed viscous oil with a low viscosity fluid to prevent contamination of said core flowed viscous oil by said non-core flowed fluid.

9. A process as in claim 8 wherein said second fraction filling step comprises filling a length of said pipeline substantially equal to about 100 pipe diameters with water.

10. A process as in claim 9 wherein said second pig placing step comprises placing a squeegee pig within said pipeline.

* * * * *